US007418830B2

(12) United States Patent
Bowen et al.

(10) Patent No.: US 7,418,830 B2
(45) Date of Patent: Sep. 2, 2008

(54) REFRIGERATOR WITH FORWARD PROJECTING DISPENSER

(75) Inventors: Michael A. Bowen, Keystone, IA (US); Lawrence J. Ertz, Amana, IA (US); Bruce A. Kopf, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 598 days.

(21) Appl. No.: 11/028,422

(22) Filed: Jan. 3, 2005

(65) Prior Publication Data

US 2006/0144074 A1 Jul. 6, 2006

(51) Int. Cl.
*B60H 1/32* (2006.01)

(52) U.S. Cl. ..... 62/344; 62/389; 222/146.6

(58) Field of Classification Search ..... 222/146.6; 62/389–390, 344
See application file for complete search history.

(56) References Cited

U.S. PATENT DOCUMENTS 2,751,757 A * 6/1956 Hobbs et al. ..... 222/180
3,640,088 A 2/1972 Jacobus et al.
3,942,334 A 3/1976 Pink
4,069,545 A 1/1978 Holet et al.
4,090,641 A 5/1978 Lindeschmidt
4,706,169 A 11/1987 Bussan et al.
4,851,662 A 7/1989 Ott et al.
5,117,654 A 6/1992 Steffenhagen
5,272,888 A 12/1993 Fisher et al.
5,273,219 A 12/1993 Beach, Jr. et al.
5,405,054 A * 4/1995 Thomas ..... 222/95
5,473,911 A 12/1995 Unger
5,474,213 A 12/1995 Unger
5,526,854 A 6/1996 Unger
5,542,265 A * 8/1996 Rutland ..... 62/389
5,701,235 A 12/1997 Hagemeyer Cook et al.
5,836,669 A 11/1998 Hed
5,941,619 A 8/1999 Stieben et al.
6,050,097 A 4/2000 Nelson et al.
6,095,673 A 8/2000 Goto et al.
6,299,025 B1 * 10/2001 Watanabe et al. ..... 222/146.6
6,425,425 B2 * 7/2002 Bianchi et al. ..... 141/362
6,679,082 B1 * 1/2004 Tunzi ..... 62/344
6,726,341 B2 4/2004 Pashley et al.
6,804,974 B1 10/2004 Voglewede et al.

(Continued)

FOREIGN PATENT DOCUMENTS

EP 1 482 263 A2 1/2004

(Continued)

*Primary Examiner*—William E Tapolcai
(74) *Attorney, Agent, or Firm*—Kirk Goodwin; Michael D. Lafrenz

(57) ABSTRACT

A refrigerator having a forward projecting dispenser that extends forward a front panel of the door. The door has an outer door pan with an outer door cavity and an inner liner having an inner liner cavity. An ice chute may be placed through both the inner liner cavity and the outer door cavity to move ice to the forward projecting dispenser. The dispenser may have a housing that positions a control panel and water outlet forward the front panel. The dispenser may extend to the door handle of the refrigerator or beyond the handle. The distance the dispenser extends forward the front panel of the door is minimized using a slight diagonal rear side of the dispenser housing.

19 Claims, 8 Drawing Sheets

U.S. PATENT DOCUMENTS

| | | | | |
|---|---|---|---|---|
| 6,836,083 | B2 | 12/2004 | Mukai | |
| 6,964,177 | B2 | 11/2005 | Lee et al. | |
| 6,964,352 | B2 * | 11/2005 | Werth | 222/146.6 |
| 7,007,500 | B2 * | 3/2006 | Lee | 62/389 |
| 7,065,975 | B1 | 6/2006 | Herndon et al. | |
| 7,076,967 | B2 | 7/2006 | Lee et al. | |
| 2005/0036300 | A1 | 2/2005 | Dowling et al. | |
| 2006/0090496 | A1 | 5/2006 | Adamski et al. | |

FOREIGN PATENT DOCUMENTS

| | | | |
|---|---|---|---|
| EP | 1 517 103 | A2 | 3/2005 |
| EP | 1 519 131 | A1 | 3/2005 |
| JP | 500 69644 | | 6/1975 |
| WO | WO 03/102481 | A1 | 12/2003 |
| WO | WO 2004/085937 | A1 | 10/2004 |

* cited by examiner

REFRIGERATOR WITH FORWARD PROJECTING DISPENSER

BACKGROUND OF THE INVENTION

The present invention relates generally to refrigerators and more particularly to ice and water dispensers located on the outer surfaces of the doors of refrigerators. As is well known, a refrigerator may be provided with an ice dispenser and a water dispenser. Such dispensers typically are mounted in a front panel of a refrigerator door. In a side-by-side refrigerator, the dispenser generally is located in the freezer compartment door. Each dispenser typically has a lever, actuator button, or actuator pad disposed at the rear most surface of the housing into which a glass or cup could be inserted for filling. A glass may be pressed against the actuary button, pad, or lever, thus activating the dispensing of water, or ice cubes, as desired.

Typically, the dispenser has a cavity that is inset into a door of the refrigerator. The inset cavity of the dispenser takes up valuable storage space within the inner compartment. This storage space is further compromised when an actuator and other circuitry is located at the rear side of the dispenser cavity.

Additionally, dispensers located within a door compartment have a cavity which receives only limited size beverage containers. For example, a typical water and ice dispenser can receiver a beverage glass that holds 12-16 ounces of fluids but not a thermos, cooler, or large capacity beverage glass such as a 48-ounce or 64-ounce cup.

Accordingly, a primary objective of the present invention is the provision of an ice and water dispenser that allows for increased storage capacity behind the ice and water dispenser.

Another objective of the present invention is the provision of an ice and water dispenser that accommodates over-sized cups, water bottles, pitchers, thermoses, coolers, etc.

These and other objectives will become apparent from the following specification and claims.

SUMMARY OF THE INVENTION

The present invention is directed towards a refrigerator with a forward projecting dispenser attached to the front panel of a refrigerator door. In general, the door of the invention includes an outer door pan, an inner door liner, preferably thermal formed, an ice chute through the door, and a dispenser attached to the door engaging the ice chute. The refrigerator door of the present invention has an outer door cavity and an inner liner cavity.

One feature of the present invention is an ice chute that is in both the liner cavity and the outer door cavity. This positioning of the ice chute permits the dispenser to be placed forward the front panel of the door to receiving ice from the ice chute.

A further feature of the present invention is a more efficient utilization of storage space upon the inner liner. The forward projecting dispenser makes unnecessary a deep dispenser cavity in both the outer door and the inner liner which necessitates a deep inner liner cavity to accommodate the dispenser protruding into the freezer door.

A further feature of the invention is the ability to permit oversized cups, water bottles, pitchers, coolers, thermoses, etc. being filled more easily as they do not need to fit within a cavity protruding into the refrigerator door. One problem typically encountered with filling oversized containers is a drip tray interfering with the positioning of the oversized container underneath the ice and/or water dispenser. Therefore, a feature of the present invention is a compressible drip pan adjacent the front panel of the refrigerator door or removable from the front panel. Additionally, the drip tray may be independent the dispenser and attached by a magnet or other attachment means which may be moved when oversize containers are being filled.

Additional objects, features and advantages of the present invention will become more readily apparent from the following detailed description of the preferred embodiments when taken in conjunction with the drawings wherein like reference numerals refer to corresponding parts in the several views.

DETAILED DESCRIPTION OF THE PREFERRED EMBODIMENT

The present invention will be described as it applies to its preferred embodiment. It is not intended that the present invention be limited to the preferred embodiment. It is intended that the invention cover all modifications and alternatives that may be included within the spirit and scope of the invention.

Figure 1:
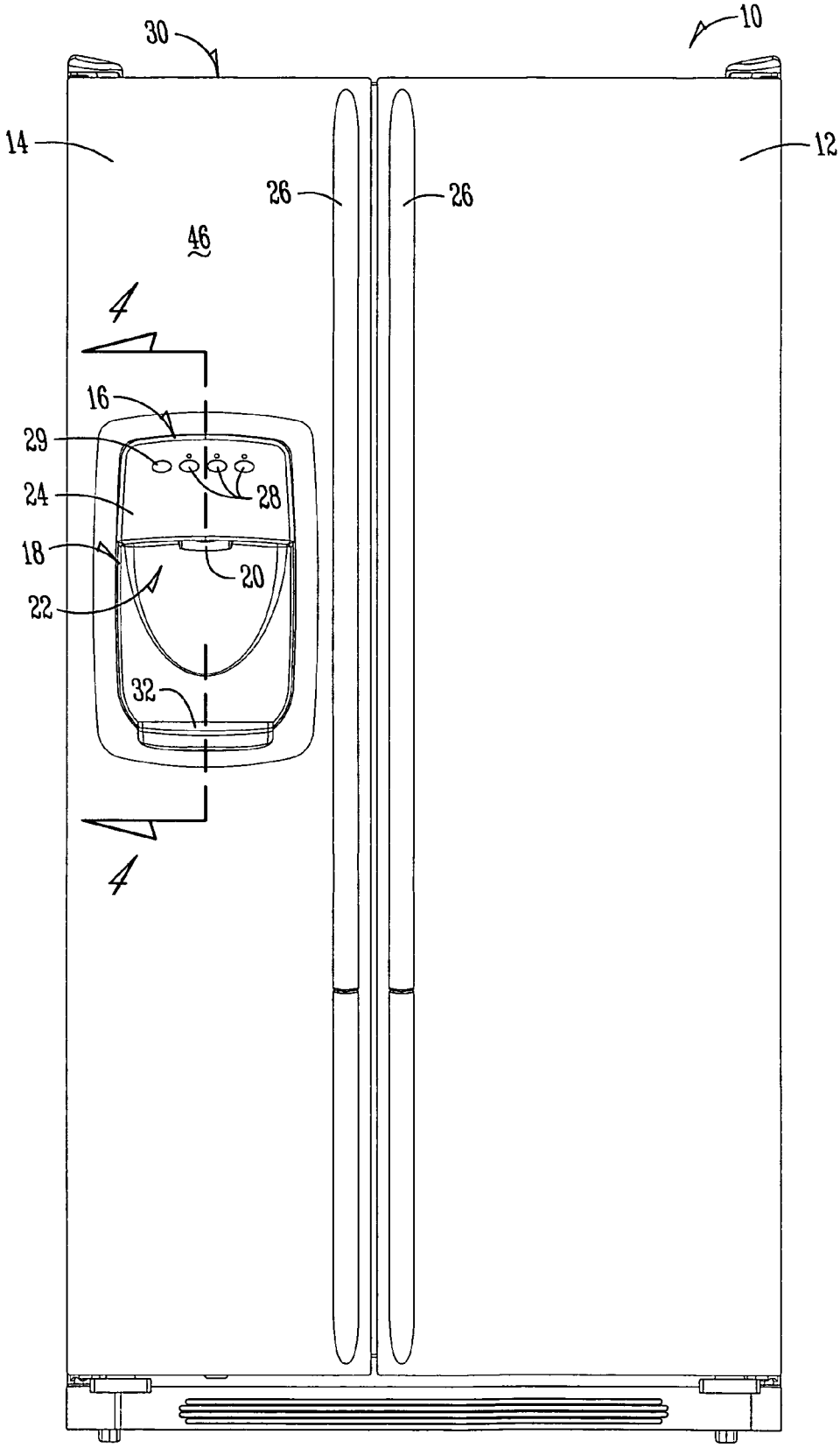
FIG. 1 is a front view of a refrigerator having a forward projecting dispenser with a drip pan included with the dispenser housing.

With reference to FIG. 1, a conventional refrigerator 10 is shown, refrigerator 10 being of the side-by-side design, wherein refrigerator 10 has a refrigeration compartment sealed by a refrigerator door 12 and a freezer compartment sealed by a freezer door 14. One of the doors 12, 14 may be provided with a dispenser 16, generally including a housing 18 defining a dispensing area 22 for an ice chute 20 and water tube 34.

Dispenser 16 may utilize ice and/or water selection buttons 28 and an actuator 29. The user may select water and/or the type of ice to be dispensed such as ice cubes or crushed ice using buttons 28. The user selects and dispenses ice and water by pressing actuator button 29 that actuates delivery of ice through the ice chute 20 and/or water through water tube 34.

It should be noted that the dispenser 16 could also be found in other types of refrigerators, other than those of side-by-side construction, and thus the dispenser of the present invention, as will hereinafter be described in greater detail, can similarly be used in both refrigerators of side-by-side design, as well as other designs.

Figure 2:
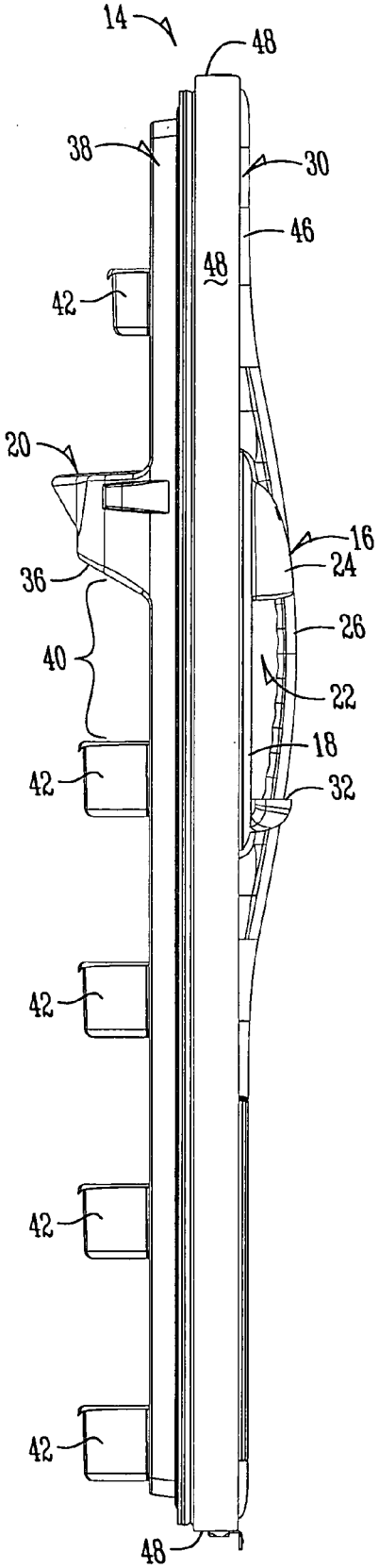
FIG. 2 is a side view of the freezer door of FIG. 1.
Figure 8:
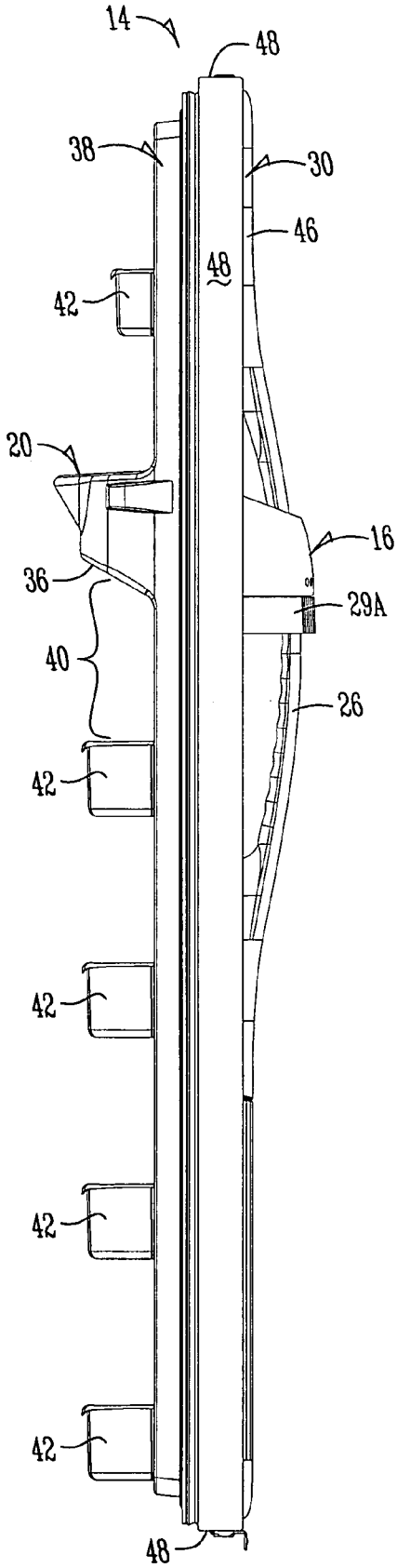
FIG. 8 is a side view of the door of FIG. 7.

The refrigerator 10 has handles 26 extending outward. The dispenser 16 extends outward from the door 14. As shown in FIG. 2 the dispenser may extend approximately level with the handles 26. Alternatively, the dispenser may extend beyond the handle especially when no dispensing cavity 22 is provided for and as illustrated in FIG. 8.

With reference to FIG. 2, the side of the ice and water dispenser 16 of the present invention is illustrated. Dispenser housing 18 frames the control panel 24, the dispensing area 22, and a catch tray or drip pan 32. The control panel 24 and drip pan 32 extend forward the front panel 46 of the outer door panel.

Figure 3:
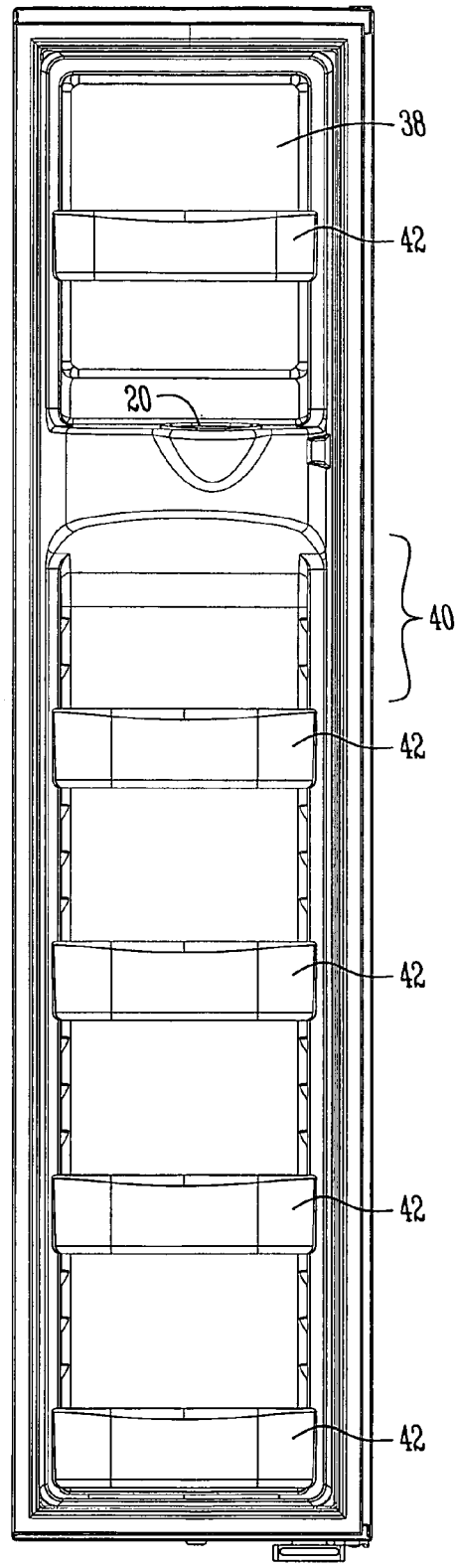
FIG. 3 is a rear view of a door using a forward projecting dispenser.
Figure 10:
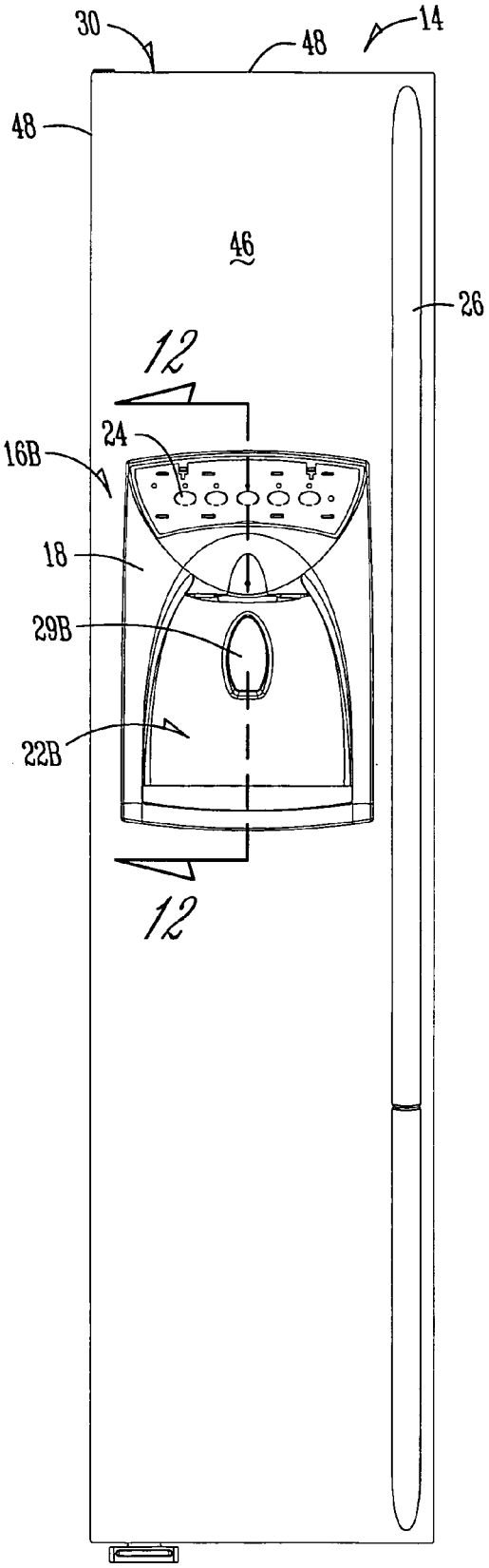
Fig. 10 (Prior Art)
FIG. 10 is a front view of a prior art ice and water dispenser.
Figure 11:
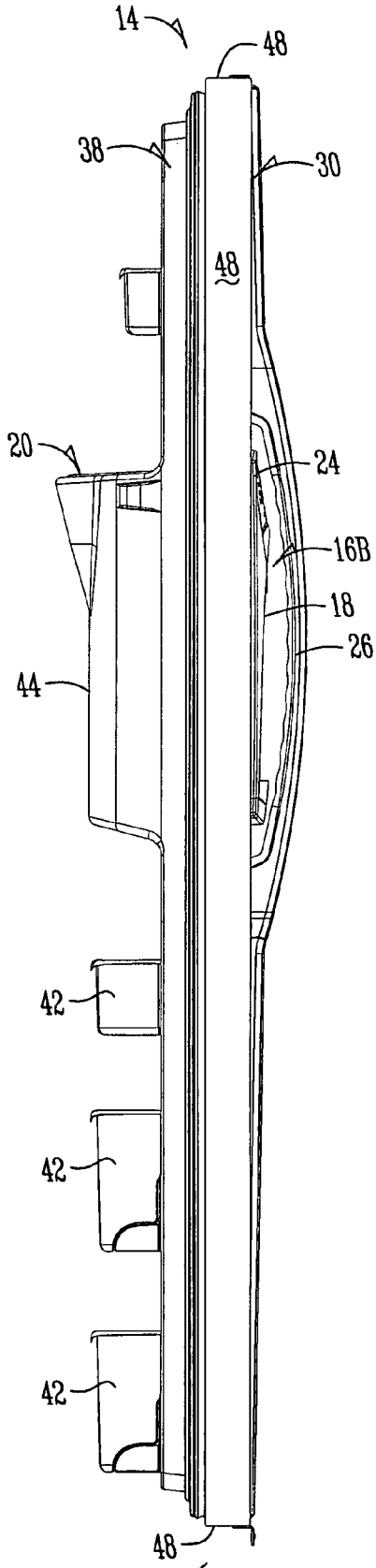
Fig. 11 (Prior Art)
FIG. 11 is a side view of the prior art ice and water dispenser of FIG. 10.
Figure 12:
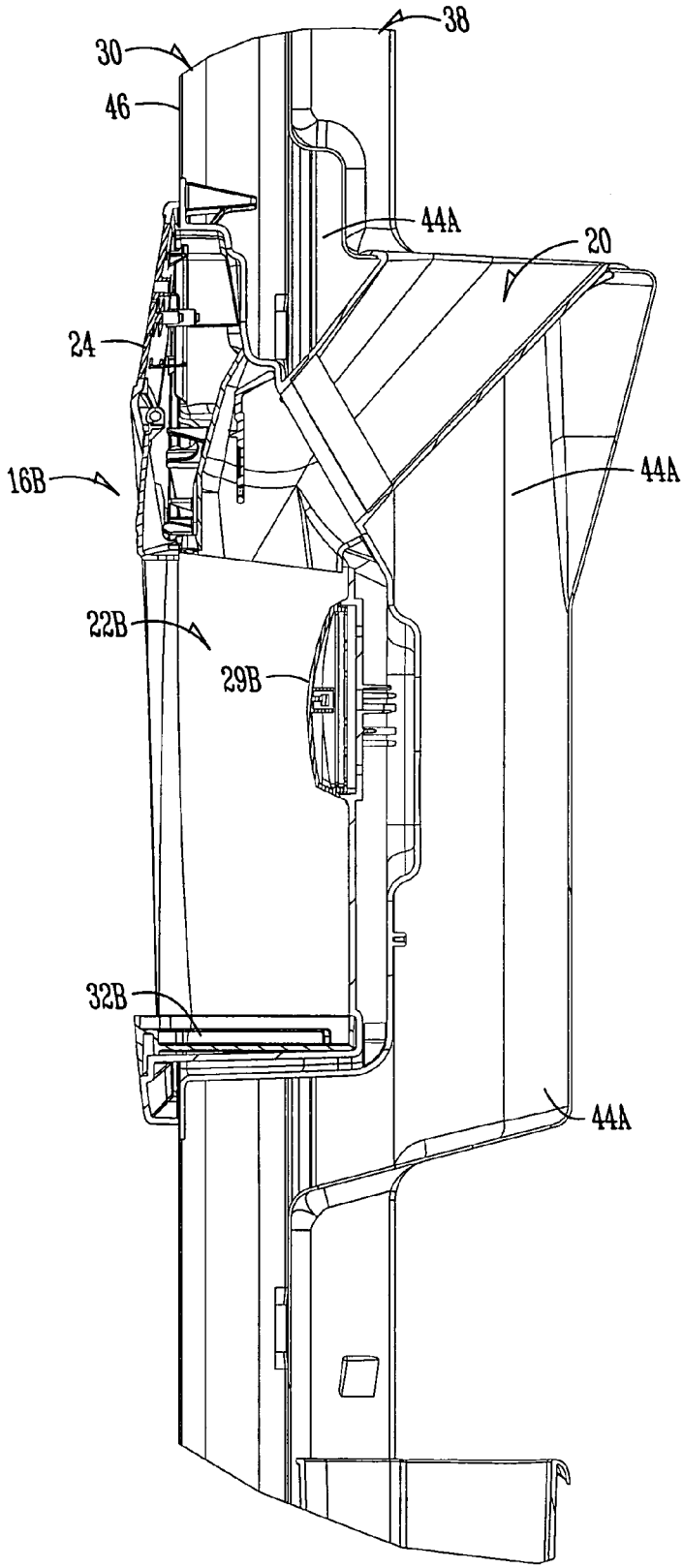
Fig. 12 (Prior Art)
FIG. 12 is a cross sectional view taken along line 12-12 of FIG. 10.

As seen in FIG. 2 and FIG. 3, the forward projecting dispenser 16 permits the ice chute 20 to be the only structure within an inner liner cavity 44. In contrast, the prior art as seen in FIGS. 10-12 require an inner liner cavity 44A to not only accommodate an ice chute but also the dispenser cavity. Accordingly, the forward projecting dispenser permits a space 40 to be available for a shelf 42. This extra space 40 is an 11-inch to 12-inch area below the ice chute 20.

In general, the doors, 12, 14 include an outer door pan 30 and an inner liner 38. The outer door pan 30 is formed of sheet metal and includes a front panel portion 46. The sheet metal is bent so as to form a top, bottom and opposing side wall portions 48. Typically, the piece of sheet metal is further bent to define a plurality of flange portions (not shown). The inner door liner 38 is thermal formed but could also be injection molded. In any event, inner door liner 38 includes a portion which defines the inner liner cavity. The inner liner 38 attaches to the outer door pan 30 typically at the plurality of flange portions. Insulation foam is then filled into the void defined by the outer door cavity 50 and the inner liner cavity 44.

Figure 4:
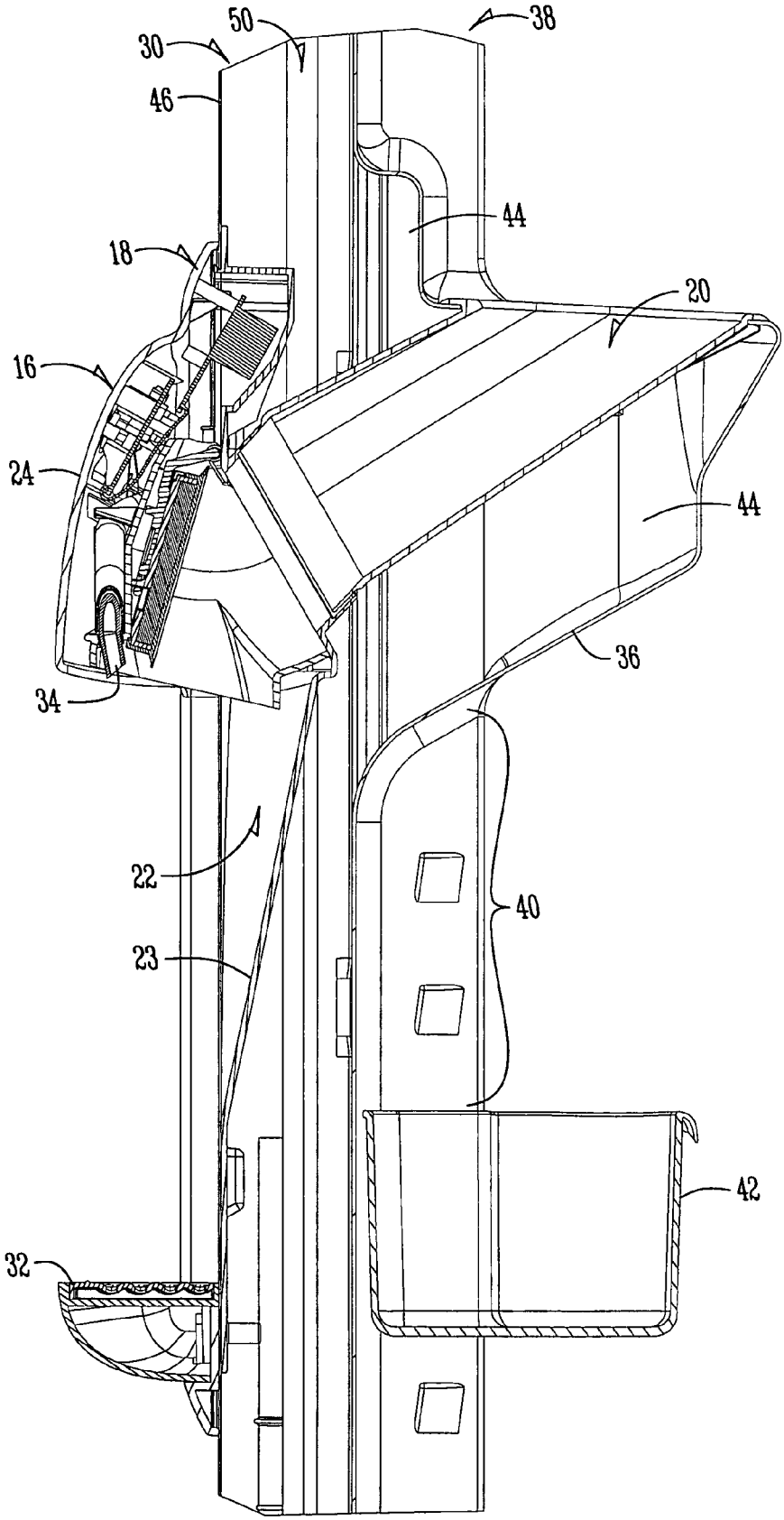
FIG. 4 is a cross sectional view taken along line 4-4 of FIG. 1.

As seen in FIG. 4, the ice chute 20 extends through both the liner cavity 44 and the outer door cavity 50. Storage space is maximized by having the liner cavity 44 partially defined by an angled side 36 that follows the diagonally mounted ice chute 20. This is different than the prior art as seen in FIG. 12 which only has the ice chute 20 extending through the liner cavity 44.

Figure 5:
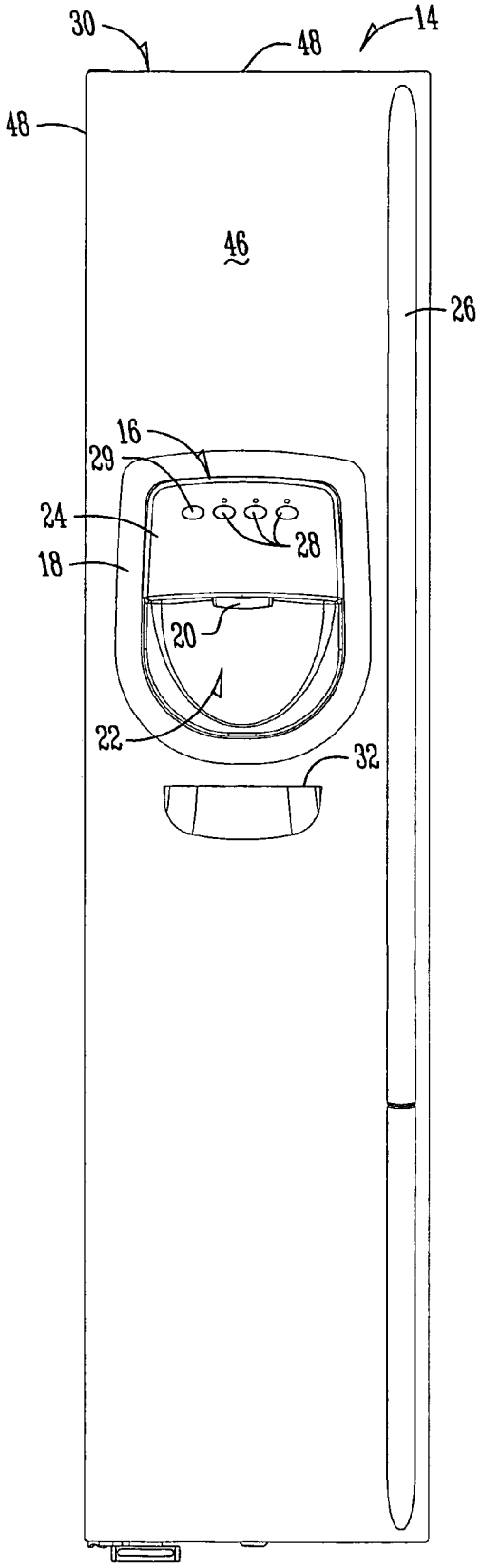
FIG. 5 is a front view of a door with a forward projecting dispenser of the present invention with a drip pan independent and removable from the dispenser housing.
Figure 6:
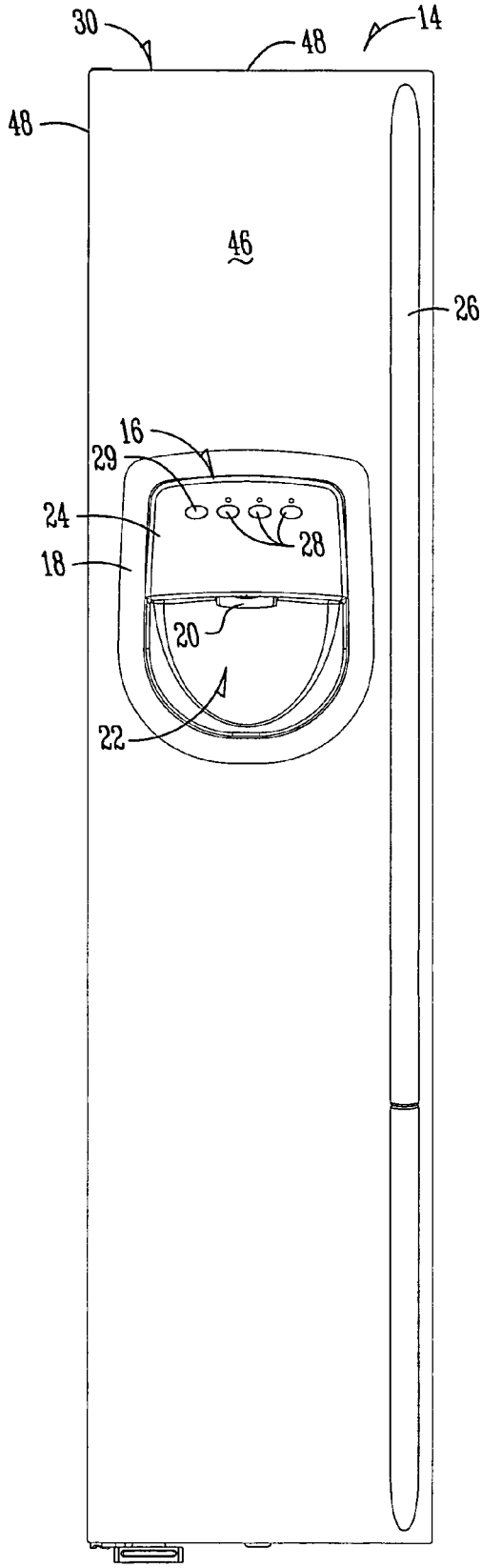
FIG. 6 is a front view of the door of FIG. 5 with the drip pan removed.

As further seen in FIG. 4, the forward projecting dispenser 16 permits a less deep ice dispenser cavity 22. As seen in FIG. 4, the dispenser cavity 22 may have an angled back side 23 protruding into the outer door cavity portion of the outer door pan 30. A drip pan 32 may be placed on the front panel 46 by an attachment such as screws or may be magnetically attached so that it may be removed as seen in FIGS. 5 and 6. The drip pan 32 may be removed whenever larger containers or oversized containers are desired to be filled.

Figure 7:
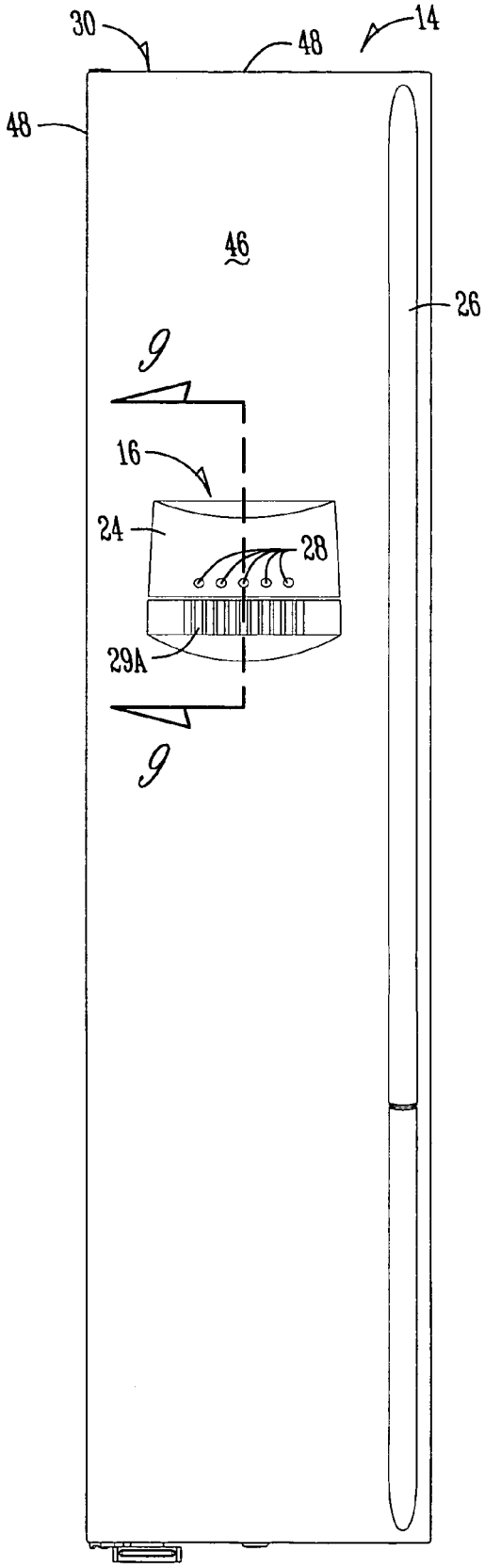
FIG. 7 is a front view of a door with a forward projecting dispenser without a dispenser cavity.
Figure 9:
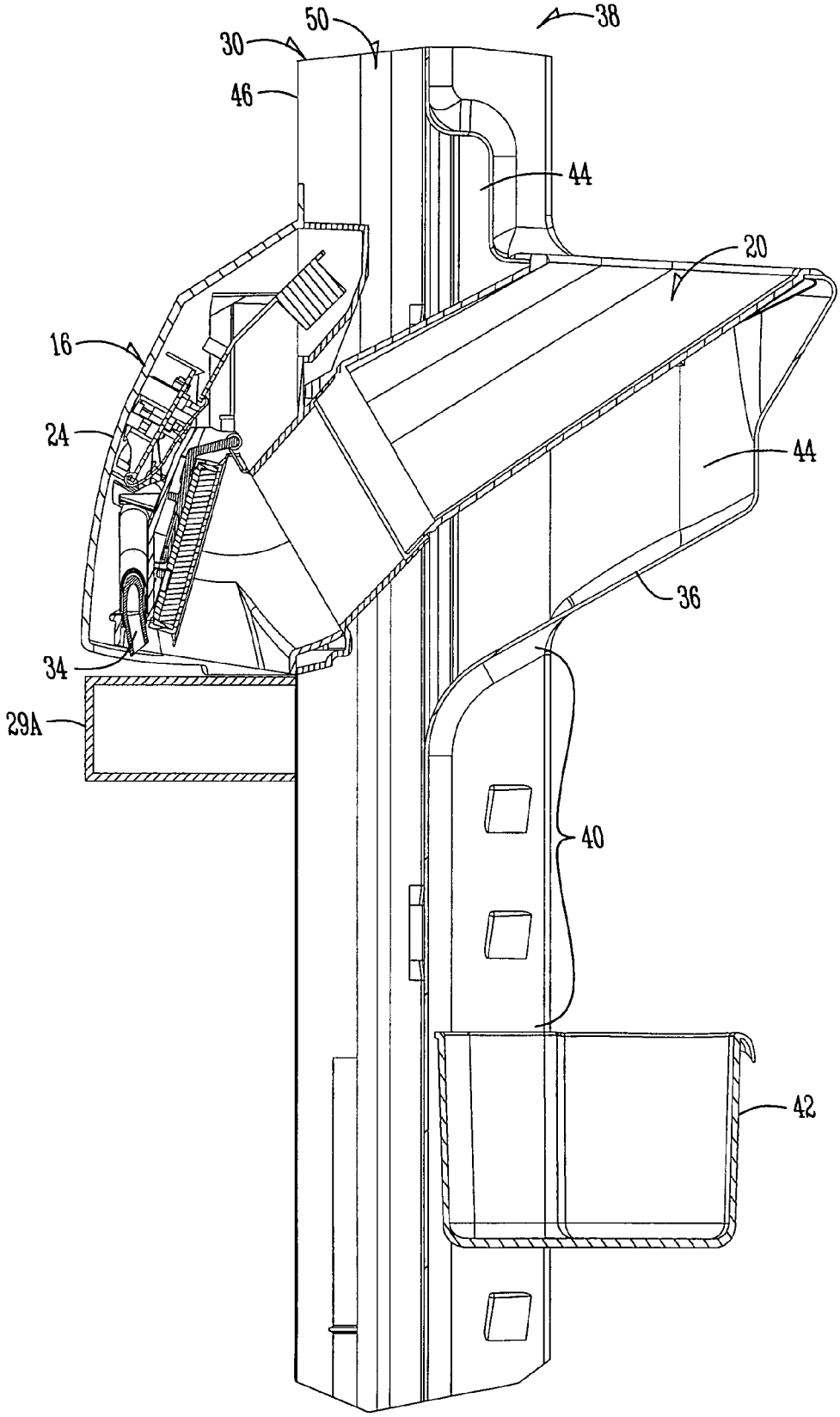
FIG. 9 is a cross sectional view taken along line 9-9 of FIG. 7.

As seen in FIGS. 7-9, an alternate embodiment of the forward projecting dispenser 16 does not utilize a dispensing cavity 22. The dispenser 16 extends forward the front panel a distance beyond the handle 26 to accommodate oversized containers. Additionally, a compressible actuator 29A is provided that is pushed inward to actuate the dispensing of ice and/or water. The actuator 29A doubles as a drip pan 32 and catches excess water when it extends back into place under the water tube 34. The actuator 29A is removable for cleaning.

The prior art, as seen in FIGS. 10-12, only shows the ice chute 20 in the inner liner 38 portion and specifically a liner cavity 44. The liner cavity is elongated to insulate the dispenser cavity 22B. The actuator 29B and related circuitry is at the rear of the cavity 22B. Also the drip pan 32B is within the cavity 22B. As seen most clearly in FIG. 11, the dispenser 16B is approximately flush with front panel 46 as opposed to forward projecting.

Based on the above, it should be readily recognized that the forward projecting dispenser 16 provides an arrangement for dispensing ice and water that enables a door to include additional internal storage space and create the potential for filling oversized containers more readily than the prior art. In any event, although described with respect to the preferred embodiment of the invention, it should be readily apparent that various changes and/or modifications can be made to the invention without departing from the spirit thereof. In general, the invention is only intended to be limited by the scope of the following claims.

What is claimed is:

1. A refrigerator comprising:

a cabinet;

a door attached to the cabinet, the door having a front panel and an inner liner;

a handle mounted on the door and extending forwardly beyond the front panel;

an ice chute extending through the liner;

an ice dispenser attached to the door and engaging the ice chute, and having a stationary ice outlet extending forwardly beyond the front panel for discharging ice into a container; and the front panel extending downwardly below the ice outlet.

2. The refrigerator of claim 1 wherein the dispenser extends forwardly beyond the front panel a distance approximately level with the handle.

3. The refrigerator of claim 1 wherein the dispenser extends forwardly beyond the front panel a distance beyond the handle.

4. The refrigerator of claim 1 wherein the dispenser includes a control panel that extends forwardly beyond the front panel.

5. The refrigerator of claim 1 wherein the ice dispenser includes a water outlet located forwardly beyond the front panel.

6. The refrigerator of claim 1 further comprising a dispenser cavity beneath the dispenser for receiving the container to receive ice from the ice outlet.

7. The refrigerator of claim 6 wherein the dispenser cavity includes an upwardly and rearwardly sloped back wall beneath the ice outlet to define a recess for receiving the ice container.

8. The refrigerator of claim 6 further comprising a water dispenser with an outlet in the ice dispenser and a drip tray attached to the door beneath the water outlet.

9. The refrigerator of claim 8 wherein the drip tray is removable.

10. The refrigerator of claim 8 wherein the drip tray is retractable.

11. The refrigerator of claim 1 wherein the ice outlet defines an ice receiving area below the outlet, and further comprising a food storage area on the inner liner directly behind the ice receiving area.

12. A refrigerator comprising:

a cabinet;

a door attached to the cabinet, the door having a front panel and an inner liner;

an ice chute extending diagonally through the liner;

an ice dispenser attached to the door and engaging the ice chute; and terminating in an outlet for discharging ice into a container positioned in an ice receiving area beneath the outlet; and a food storage area on the inner liner directly behind the ice receiving area.

13. The refrigerator of claim 12 further comprising a dispenser cavity beneath the dispenser for receiving containers.

14. The refrigerator of claim 12 further comprising a drip pan attached to the front panel below the dispenser.

15. The refrigerator of claim 12 wherein the ice dispenser extends in front of the door.

16. The refrigerator of claim 13 wherein the ice dispenser cavity extends in front of the door.

17. The refrigerator of claim 12 wherein the outlet extends in front of the door.

18. The refrigerator of claim 6 wherein the dispenser cavity extends in front of the door.

19. The refrigerator of claim 12 wherein the ice outlet is stationary.

* * * * *